US006467926B1

(12) United States Patent
Tee et al.

(10) Patent No.: US 6,467,926 B1
(45) Date of Patent: Oct. 22, 2002

(54) ADORNMENT LAMP

(76) Inventors: Margaret Tee, P.O. Box No. 6-57, Chung-Ho City, Taipei Hsien 235 (TW); Hans Peter Henning, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/835,143

(22) Filed: Apr. 16, 2001

(51) Int. Cl.[7] ..... F21V 33/00

(52) U.S. Cl. ..... 362/101; 362/806; 362/811; 362/96

(58) Field of Search ..... 362/101, 806, 362/811, 154, 318, 96, 562

(56) References Cited

U.S. PATENT DOCUMENTS 2,520,691 A * 8/1950 Otis ..... 313/110
3,780,260 A * 12/1973 Elsner ..... 219/271
5,067,060 A * 11/1991 Sieracki ..... 362/101
5,803,580 A * 9/1998 Tseng ..... 362/96

FOREIGN PATENT DOCUMENTS

JP 06274115 A * 9/1994 ..... G09F/19/02

* cited by examiner

*Primary Examiner*—Alan Cariaso

(57) ABSTRACT

An adornment lamp comprises a container-like shade including a transparent liquid contained therein and a plurality of reflective tiny pieces immersed in the transparent liquid; a transparent tube assembly surrounded by the shade and including a lower first container having a hollow cylindrical shape open to the bottom, a colored liquid contained in the first container, an upper second container, and an intermediate helical tube in fluid communication with the first and second containers; and a stand having a light source surrounded by the first container. When the light source is activated, the transparent liquid and the colored liquid are heated by the emitted light of the light source, whereby a convection is generated in the transparent liquid for moving and revolving the tiny pieces, and drops are formed by the colored liquid and continuously moved upward along the tube.

4 Claims, 3 Drawing Sheets

ADORNMENT LAMP

BACKGROUND OF THE INVENTION

1. Field of the Invention

The present invention relates to lamps and more particularly to an adornment lamp with improved characteristics.

2. Description of the Prior Art

Adornment lamps have been popular among people for a long time. In recent years, a number of adornment lamps have been developed. For example, there is an adornment lamp comprising a corn-shaped container containing a transparent liquid and a plurality of reflective particles immersed in the liquid, and a light source surrounded by the container. Hence, in operation the heat generated by the emitted light of light source may cause the transparent liquid to move convectively. As such, the immersed particles are also moved and revolved, thus reflecting omni-directionally. This can bring a flashing effect. Another type of adornment lamp is characterized in that the transparent liquid is replaced by two types of liquid which are different in density and color and unsolvable each other. Hence, in operation the heat generated by the emitted light of light source may cause both types of liquid to move convectively. But the direction and speed of the convection of one type of liquid is different from that of the convection of the other type of liquid. As a result, it brings a visual effect of two types of liquid having different color moving convectively. But these designs are still unsatisfactory. Thus, it is desirable to provide an improved adornment lamp.

SUMMARY OF THE INVENTION

It is an object of the present invention to provide an adornment lamp comprising a container-like shade including a transparent liquid contained therein and a plurality of reflective tiny metal pieces immersed in the transparent liquid; a transparent tube assembly surrounded by the shade and including a lower first container having a hollow cylindrical shape open to the bottom, a colored liquid contained in the first container, a helical tube on the top of the first container in fluid communication therewith, and a second container on the top of the tube in fluid communication therewith; and a stand having a light source with the bottom of the shade fitted on the stand and the light source surrounded by the first container; wherein when the light source is activated, the transparent liquid in the shade and the colored liquid in the first container are heated by the emitted light of the light source, whereby a convection is generated in the transparent liquid for moving and revolving the immersed tiny metal pieces, a plurality of drops are formed by the colored liquid, the drops are continuously moved upward along the tube.

The above and other objects, features and advantages of the present invention will become apparent from the following detailed description taken with the accompanying drawings.

DETAILED DESCRIPTION OF THE PREFERRED EMBODIMENTS

Figure 1:
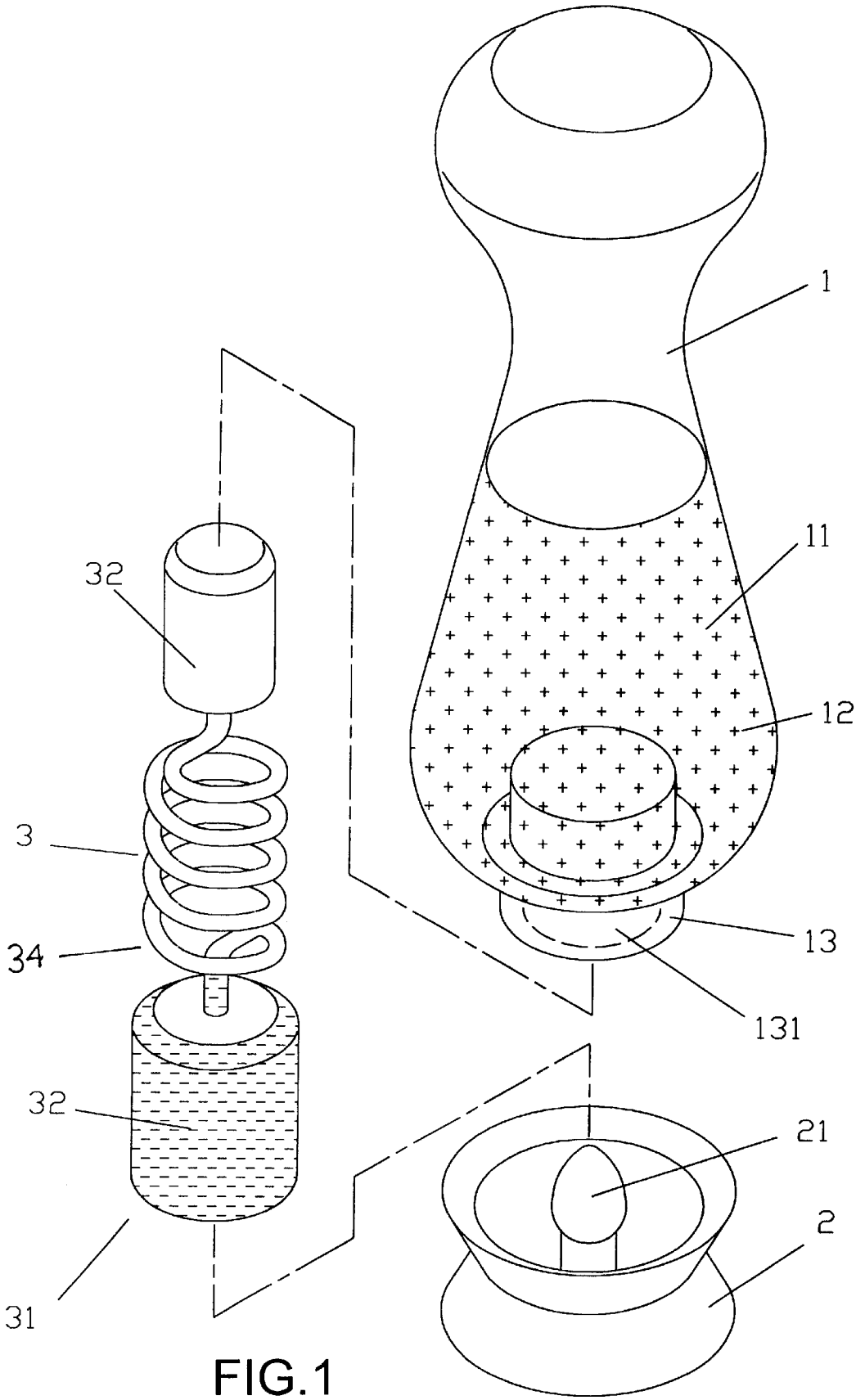
FIG. 1 is an exploded view of a preferred embodiment of adornment lamp according to the invention.
Figure 2:
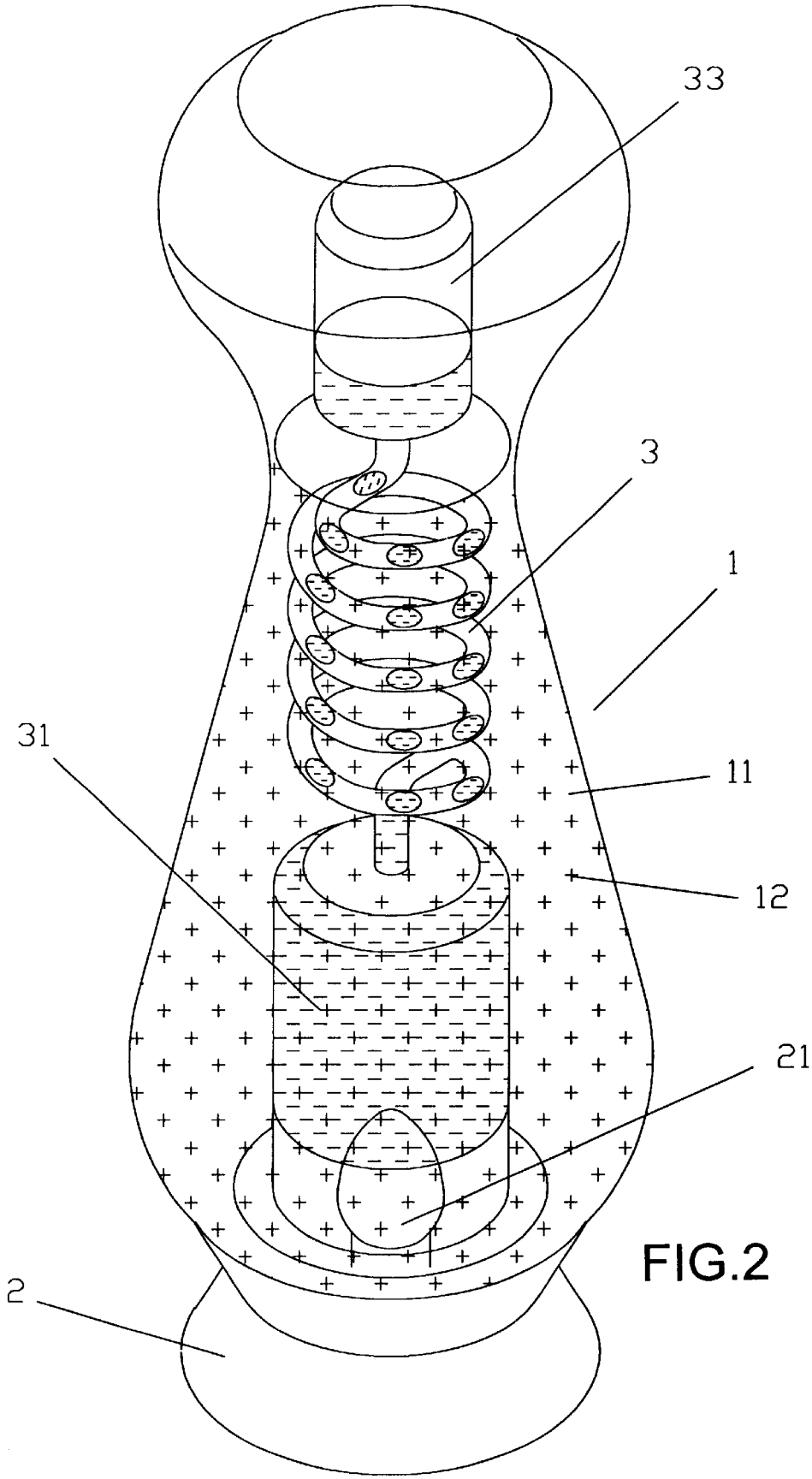
FIG. 2 is a perspective view of the FIG. 1 lamp.

Referring to FIGS. 1 and 2, there is shown an adornment lamp constructed in accordance with the invention comprising a container-like shade 1 including a transparent liquid 11 contained therein and a plurality of reflective tiny pieces 12 (e.g., ones made of metal) immersed in the liquid 11, and a circular flange 13 having a central bore 131 on the underside; a transparent tube assembly 3 surrounded by the shade 1 and including a lower first container 31 having a hollow cylindrical shape open to the bottom, a colored liquid 32 contained in the first container 31, an upper second container 33, and an intermediate helical tube 34 in fluid communication between first and second containers 31 and 33; and a stand 2 having a light source 21 in the center wherein the flange 13 is snugly fitted on the stand 2 with the light source 21 surrounded by the first container 31.

Figure 3:
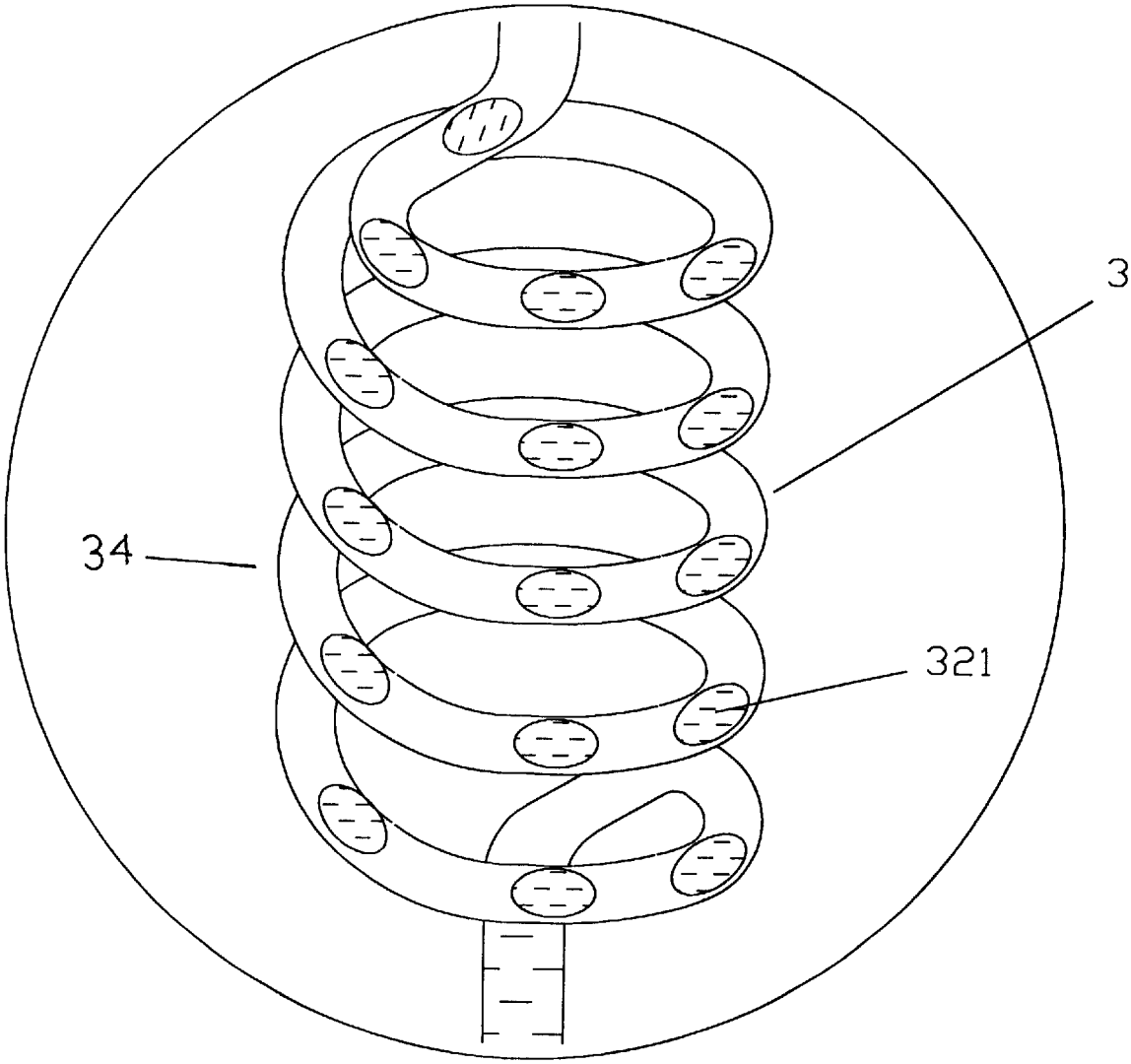
FIG. 3 is a greatly enlarged fragmentary view of the transparent tube assembly of FIG. 1.

Referring to FIGS. 2 and 3, the operation of the invention will now be described. When light source 21 is turned on, the emitted light of light source 21 may heat liquid 11 in the shade 1 and liquid 32 in first container 31. Hence, a convection is generated in liquid 11 in the shade 1. As such, the immersed tiny pieces 12 are also moved and revolved, thus reflecting omni-directionally. This can bring a flashing effect. Further, a plurality of drops 321 are formed by liquid 32 in first container 31 when it is subjected to heat. These light drops 321 are thus continuously moved upward along the tube 34 to reach and store in the second container 33. This can bring a dynamic effect in addition to the above flashing effect.

While the invention has been described by means of specific embodiments, numerous modifications and variations could be made thereto by those skilled in the art without departing from the scope and spirit of the invention set forth in the claims.

What is claimed is:

1. An adornment lamp comprising:

a container-like shade including a transparent liquid contained therein and a plurality of reflective tiny metal pieces immersed in said transparent liquid;

a transparent tube assembly surrounded by said shade and including a lower first container having a hollow cylindrical shape open to said bottom, a colored liquid contained in said first container, and a tube on said top of said first container in fluid communication therewith; and a stand having a light source with said bottom of said shade fitted on said stand and said light source surrounded by said first container;

wherein when said light source is activated, said transparent liquid in said shade and said colored liquid in said first container are heated by said emitted light of said light source, whereby a convection is generated in said transparent liquid for moving and revolving said immersed tiny metal pieces, a plurality of drops are formed by said colored liquid, said drops are continuously moved upward along said tube.

2. The adornment lamp of claim 1, wherein said tube is of helical shape.

3. The adornment lamp of claim 1, wherein said transparent tube assembly further comprises a second container on said top of said tube in fluid communication therewith.

4. The adornment lamp of claim 1, further comprising a circular flange having a central bore on said underside of said shade wherein said flange is fitted on said stand.

* * * * *